US008763600B2

(12) United States Patent
Catalogne et al.

(10) Patent No.: US 8,763,600 B2
(45) Date of Patent: Jul. 1, 2014

(54) GAS BURNER FOR A COOKTOP

(75) Inventors: Cedric Catalogne, Torreano di Martignacco (IT); Lorenzo Gattei, Forli (IT); Marco Starnini, Forli (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 734 days.

(21) Appl. No.: 12/676,661

(22) PCT Filed: Jul. 22, 2008

(86) PCT No.: PCT/EP2008/059596
§ 371 (c)(1),
(2), (4) Date: Oct. 27, 2010

(87) PCT Pub. No.: WO2009/037034
PCT Pub. Date: Mar. 26, 2009

(65) Prior Publication Data

US 2011/0036341 A1 Feb. 17, 2011

(30) Foreign Application Priority Data

Sep. 21, 2007 (EP) ..... 07116965

(51) Int. Cl.
*F24C 3/00* (2006.01)

(52) U.S. Cl.
USPC ..... 126/39 E; 126/39 R; 126/218

(58) Field of Classification Search
USPC ..... 126/39 E, 218; 239/513
See application file for complete search history.

(56) References Cited

U.S. PATENT DOCUMENTS

| | | | | |
|---|---|---|---|---|
| 3,597,135 | A * | 8/1971 | Kweller et al. | 431/148 |
| 4,105,163 | A * | 8/1978 | Davis et al. | 239/406 |
| 4,629,415 | A * | 12/1986 | DeWerth et al. | 431/347 |
| 4,779,606 | A * | 10/1988 | Vanderman | 126/39 E |
| 6,322,354 | B1 * | 11/2001 | Carbone et al. | 431/284 |
| 6,325,619 | B2 * | 12/2001 | Dane | 431/284 |

(Continued)

FOREIGN PATENT DOCUMENTS

| | | | |
|---|---|---|---|
| DE | 557157 | | 8/1932 |
| JP | 55033528 | A * | 3/1980 |

(Continued)

OTHER PUBLICATIONS

International Search Report for PCT/EP2008/059596, dated Oct. 8, 2008, 3 pages.

(Continued)

*Primary Examiner* — Kang Hu
*Assistant Examiner* — John C Hailey, III
(74) *Attorney, Agent, or Firm* — Pearne & Gordon LLP

(57) ABSTRACT

The present invention refers to a gas burner (16), in particular a gas burner for a cooktop, comprising a plurality of burning portions (40, 42, 44). A gas burner according to the present invention comprises a plurality of burning portions (40, 42, 44) adapted to receive a gas flow from gas supply means (20, 30, 36) that comprise injector means (20) adapted to eject a gas flow diverging along the flow direction (10) to define a spreading angle Y. The gas burner is characterized in that gas-flow adjusting means (24, 25) are provided for modifying said spreading angle Y such that said gas flow is enabled to supply one or more of said plurality of burning portions (40,42, 44) depending on the adjustment of said spreading angle Y.

21 Claims, 9 Drawing Sheets

(56) References Cited

U.S. PATENT DOCUMENTS

| | | | | |
|---|---|---|---|---|
| 6,331,107 | B1 * | 12/2001 | Philippe | 431/285 |
| 6,332,460 | B1 * | 12/2001 | Paesani | 126/39 R |
| 7,594,812 | B2 * | 9/2009 | Armanni | 431/283 |
| 8,087,928 | B2 * | 1/2012 | Horn et al. | 431/187 |
| 2007/0154858 | A1 * | 7/2007 | Cadima | 431/354 |
| 2009/0047611 | A1 * | 2/2009 | Armanni | 431/284 |
| 2010/0003625 | A1 * | 1/2010 | Ohlsen et al. | 431/181 |
| 2010/0248174 | A1 * | 9/2010 | Horn et al. | 431/354 |
| 2011/0120445 | A1 * | 5/2011 | Armanni | 126/39 E |
| 2011/0294079 | A1 * | 12/2011 | McBride et al. | 431/126 |

FOREIGN PATENT DOCUMENTS

| | | | |
|---|---|---|---|
| JP | 56030518 A | * | 3/1981 |
| WO | 9908046 | | 2/1999 |
| WO | 2006019279 | | 2/2006 |

OTHER PUBLICATIONS

V. Faire, T. Poinsot. "Experimental and numerical investigations into active control of a jet for combustion applications". Journal of Turbolence, vol. 5, No. 025, 2004. URL: ww.cerfacs.fr/{cfdbib/repository/TR_CFD_04_90.pdf>.

* cited by examiner

GAS BURNER FOR A COOKTOP

The present invention refers to a gas burner, in particular a gas burner having a plurality of burning portions, intended for use in the cooktop of a cooking range or similar appliance.

Gas-fired cooktops—as they are currently becoming popular on the marketplace—usually include high heat-input gas burners, e.g. burners having a heat-input rating in excess of 3 kW. In such gas burners, the burning portions usually comprise at least two concentric flame rings for as evenly as possible spreading out the amount of heat generated by the burner over a relatively large and wide operating area, so as to be able to as evenly as possible heat up even large-sized pans and pots.

Known in the art are in this connection gas burners, in which the flame rings are supplied through a single gas-injection pipe, which a cock for regulating the gas flow is generally associated to. In gas burners of this kind, to the particular purpose of preventing the frequently limiting condition from occurring, in which the various flame rings of a burner keep in all cases and constantly operating, i.e. burning all together regardless of this being or not being strictly necessary, actually, as for instance in the case in which the surface area of the bottom of the vessel being heated up is not so large, i.e. is small-sized, as well as in view of optimizing the distribution of the heat output of the gas burner under any circumstance, a number of solutions have been proposed in the art.

So, for example, there have been developed and provided gas burners featuring several flame rings, in which the flame rings themselves are supplied separately. A largely known example of gas burners of this kind is disclosed in the patent application WO 9908046.

With reference to what is set forth and described in the above-cited patent application, when assembled together, the totality of the parts making up a gas burner forms a lower chamber and an upper chamber therewithin, wherein these chambers are separated from each other by a horizontally extending partition. In the lower chamber there is housed a first gas-injection pipe provided with an injector giving into a first air/gas mixing device formed of a Venturi tube that branches off into two conduits supplying the outermost flame ring. In the upper chamber there is in turn housed a second gas-injection pipe provided with an injector giving into a second air/gas mixing device formed of a Venturi tube supplying the innermost flame ring.

The flow rate in the gas-injection pipes, and therefore also the heat output that the single flame rings are capable of developing, is caused to vary, i.e. is adjusted by properly setting a two-way gas cock having various operating settings. In one of these operating settings of such gas cock, the gas flows being ejected from the two nozzles or injectors of the corresponding two gas-injection pipes mix up with the air in the two respective air/gas mixing devices and—as a result—both flame rings are supplied. In a different operating setting of the gas cock, in which the flow rate of the gas is reduced, a flow of gas is solely ejected by the injector of the second gas-injection pipe to solely flow into the second air/gas mixing device, so that only the inner flame ring is supplied with the related combustion mixture. For it to be able to operate regularly, the gas burner requires that either both flame rings or the sole inner flame ring are ignited, depending on the actual needs, such as for instance the size of the pan. Considered—but not described any further, actually—in the same patent application there is a further embodiment, which provides for the gas flow-rate to be able to be adjusted by means of two gas cocks.

A drawback of gas burners of the above-described kind generally derives from the fact that the various flame rings, i.e. burning portions are supplied through a respective plurality of distinct injectors associated to the burning portions themselves, thereby involving quite considerable a complexity in the construction of the burners, as well as a considerably large size—and related large mounting space requirements—thereof, which is certainly not a satisfactory or even acceptable condition in view of the application of these burners in cooktops, particularly when these cooktops are of the type intended for use in the home.

Known in the art there are furthermore gas burners, in which the heating portion is formed of a plate of porous or ceramic material, i.e. the so-called catalytic burners. In a traditional embodiment thereof, a catalytic gas burner for home use comprises a support of porous material, generally in the shape of a regular polyhedron, in which an appropriate catalyst is dispersed in a zone that is generally defined as the reaction zone in this particular case. One of the two faces of the support of porous material is exposed to and hit by a jet of fuel issuing from at least one injector means located in proximity of the support of porous material itself. The fuel then diffuses and propagates through such support of porous material towards the reaction zone, while mixing up with a comburent, i.e. a combustion-assisting substance, diffusing from the opposite face of the support of porous material, thereby allowing the combustion process to take place.

In catalytic gas burners of this kind, the entire support of porous material is involved by combustion, i.e. combustion takes place over the whole area of such support. The sole possibility existing for the amount of heat developed by such combustion to be adjusted lies in controlling the rate of the reaction by regulating the flow rate of the flue, without any possibility existing for the surface area of the support of porous material involved by combustion to be varied, actually.

It is therefore a main object of the present invention to do away with the drawbacks and disadvantages of gas burners featuring a plurality of burning portions, as they are currently known in the art. Within this general object, it is a main purpose of the present invention to provide a gas burner having a plurality of burning portions, in which a set of the plurality of burning portions are supplied by appropriately adjusting the jet of gas issuing from an injector.

Another purpose of the present invention is to provide a burner comprising a plurality of burning portions, in which the set of burning portions that is intended to be involved by the combustion process can be properly and duly selected.

A further purpose of the present invention is to provide such gas burner comprising a plurality of burning portions with a structure that is much simpler and more compact.

Still another purpose of the present invention is to provide a gas burner comprising a plurality of burning portions, in which the area of the surface involved by the combustion process can be varied in accordance with actual needs and requirements.

Yet a further purpose of the present invention is to provide a gas burner comprising a plurality of burning portions, which is capable of reaching the above-noted aims and purposes at fully competitive costs, and is further capable of being produced using manufacturing means as they are largely known and readily available in the art.

An important advantage of the gas burner comprising a plurality of gas portions made up by a plurality of flame rings according to the present invention is given by the fact that a turbulence of the gas jet is created with the result that the amount of air drawn in by such jet is increased under improvement of the combustion mixture.

An advantage of a gas burner comprising a plurality of burning portions made up by portions of a porous or ceramic material according to the present invention derives from the possibility for the control of the reaction rate to be improved through an appropriate fuel injection system.

A further advantage of the present invention lies in the possibility for cooktops for household and/or professional use to be manufactured, which are adapted to precisely heat up pans and pots being most varied in the size and shape thereof.

According to the present invention, these aims, along with further ones that will become apparent from the following disclosure, are reached in a gas burner comprising a plurality of burning portions that incorporates the features and characteristics as defined and recited in the appended claims.

Advantages and features of the present invention will anyway be more readily understood from the description of some exemplary embodiments that is given below by way of non-limiting example with reference to the accompanying drawings, in which:

FIG. 1*a* is a cross-sectional view of the controlled gas-jet injector shown in FIG. 1*b*, as viewed along the line I-I therein;

FIG. 1*b* is a schematic plan view of a controlled gas-jet injector;

FIGS. 1*c* and 1*d* are schematic views of the controlled gas-jet injector shown in FIG. 1*a*, as viewed in two different operating states thereof.

Figure 6:
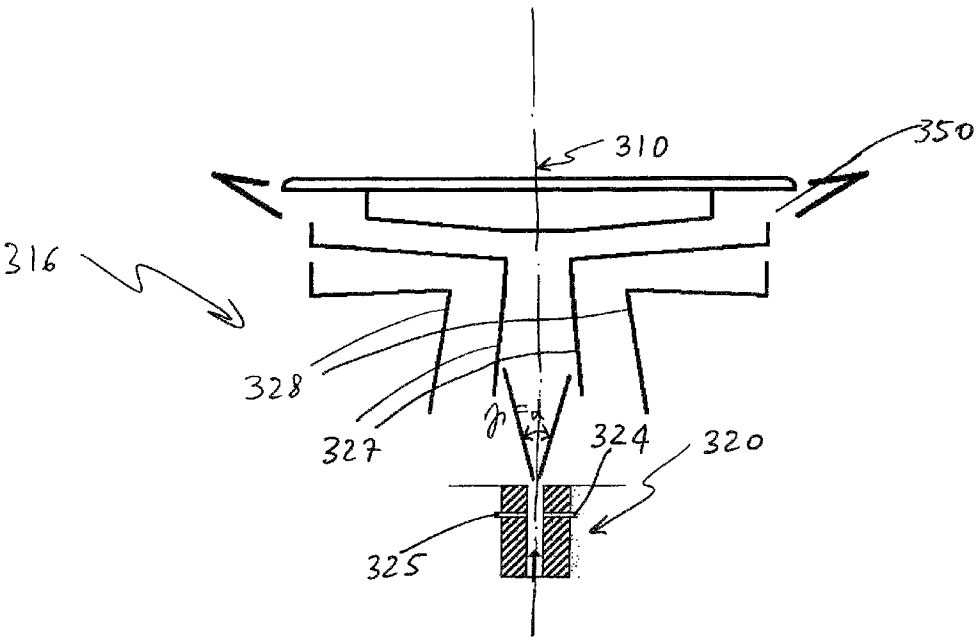
Figure 7:
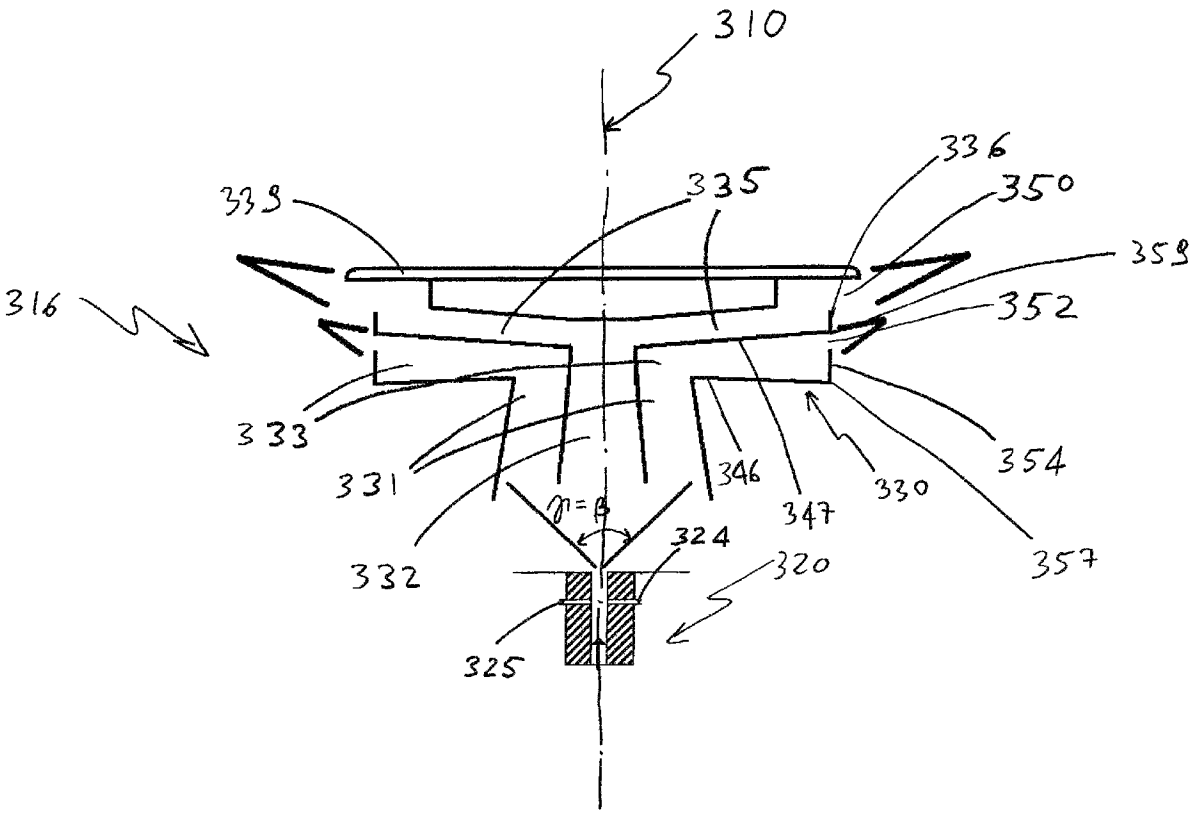
Figure 8:
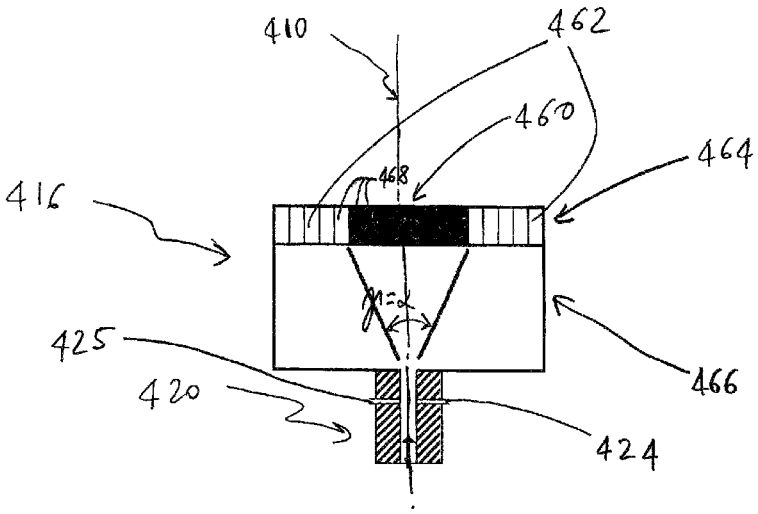
Figure 9:
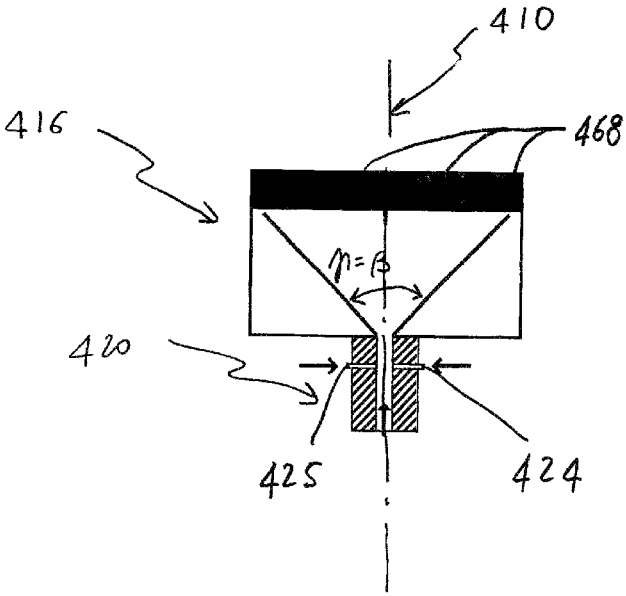

FIGS. 6 and 7 are schematic views of a second preferred embodiment, in which there is provided a gas burner featuring a single flame ring with adjustable heat input; and FIGS. 8 and 9 are schematic views of a third preferred embodiment of a gas burner comprising a plurality of burning portions that uses a controlled gas-jet injector according to the present invention, wherein the burning portions consist of portions of a porous support.

A gas burner according to the present invention is supplied by a flow of gas formed in and ejecting from an injector that is made and provided in accordance with the teachings contained in the study by Vincent Faivre and Thierry Poinsot that has been published in the *Journal of Turbulence* 5:025 (2004) under the title of "Experimental and Numerical Investigations into Active Control of a Jet for Combustion Applications", and can be found at the Internet address of:

http://www.cerfacs.fr/~cfdbib/repository/TR CFD 04 90.pdf

The purpose of the research work described in the above-cited study was to develop an actuator device to control the mixing enhancement of an axisymmetric non-reactive jet. The actuators consist of small jets feeding the primary jet flow. These jets are oriented at adding an azimuthal component to the velocity field. In particular, following points and issues are tackled by the Authors:

the optimum orientation of the actuators;

the effect of the distance of the actuators from the gas-jet outlet of the injector;

the effect of the ratio of the gas flow-rates of the actuators to the gas flow-rate of the main conduit; and, finally, the diffusion angle of the gas jet.

Illustrated in FIGS. 1*a* to 1*d* there is one of the injectors described in the publication cited above, i.e. an injector that has been found as being particularly well-suited to reaching the purposes of the present invention, wherein it will of course be appreciated that even other types of injectors of the kind described in said publication may as well be employed to feed a gas burner falling within the scope of the present invention.

In FIGS. 1*a* to 1*d*, a controlled gas-jet injector 20 is provided with an inner main gas-injection conduit 22 having a circular cross-section shape, extending along an axis 10, and so sized as to ensure an adequate gas flow rate. At least an actuator conduit, which has a smaller size than said main conduit, is provided to supply additional gas into the main conduit 22.

Figure 1A:
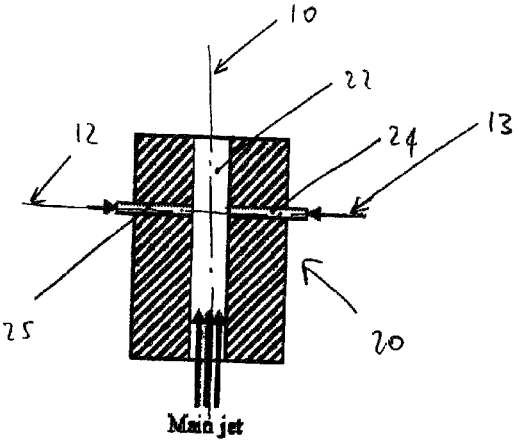
Figure 1B:
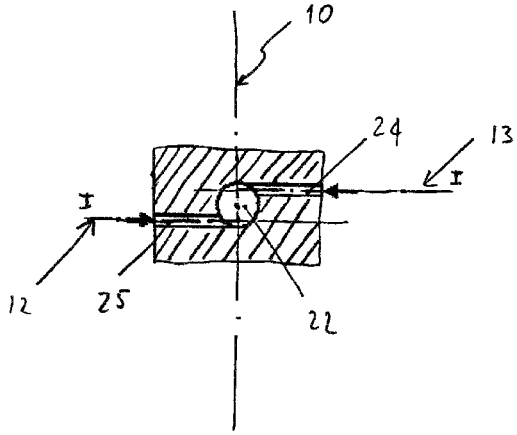
Figure 1C:
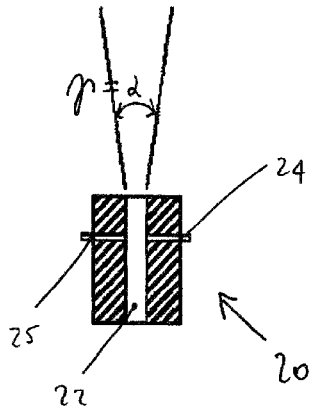
Figure 1D:
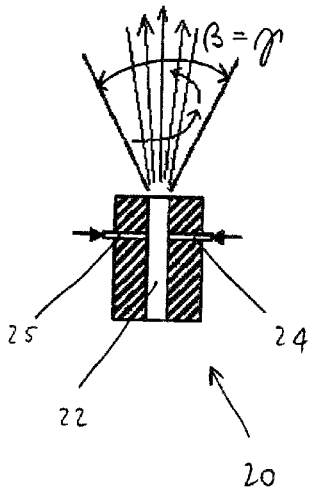

In the preferred embodiments, two gas-flow adjusting means 24 and 25 are provided to connect to the main conduit 22. The diameter of such gas-flow adjusting means 24 and 25 and the orientation thereof are critical parameters as far as the gas control efficiency is concerned, and are selected accordingly. On the other hand, the number of the gas-flow adjusting means 24 and 25 that are to be or can be employed depends on the size, i.e. the cross-section area of the main conduit 22. Preferably, the axes 12 and 13 of the gas-flow adjusting means 24 and 25 are both perpendicular to the axis of injection 10 of the main conduit 22, and the gas-flow adjusting means 24 and 25 themselves connect to the main conduit 22 tangentially, as this is best shown in FIG. 1*b*.

The gas jet ejected by the injector 20 diverges along the flow direction or axis of injection 10, thereby defining an angle of a spread $\gamma$. The spreading angle $\gamma$ of the gas jet issuing from the controlled gas-jet injector 20 is controlled through the gas injection in the gas-flow adjusting means 24 and 25, so that the spreading angle $\gamma$ of the gas jet is capable of varying between two different borderline angle spreads, i.e. a minimum and a maximum one, which are defined by the angles $\alpha$ and $\beta$, respectively, shown in FIGS. 1*c* and 1*d*. The jet of gas issuing from the controlled gas-jet injector 20 has an angle of a spread a (FIG. 1*c*) when the gas flows from the main conduit 22 and the gas-flow adjusting means 24 and 25 are inactive, i.e. not operative. The jet of gas issuing from the controlled gas-jet injector 20 has on the contrary an angle of a spread $\beta>\alpha$ (FIG. 1*d*) when the gas-flow adjusting means 24 and 25 are injecting gas into the main conduit 22 tangentially and, as a result, downstream from this point of injection the motion of the gas flow divides into a middle rectilinear component along the axis of injection 10 at a high kinetic energy and a peripheral tangential component causing the peripheral portion of the gas flow to rotate about the axis of injection 10. As a result, the angle $\beta$ of the gas at the outlet of the controlled gas-jet injector 20 is greater than the angle $\alpha$, so that the gas tends to expand with a turbulent motion. The variation of the angle $\gamma$ between the minimum value $\alpha$ and the maximum value $\beta$ thereof can be caused to equivalently take place both in a continuous manner and in a selective manner according to the actual needs and requirements. In the embodiments and related variants that will be described below, use may be equally made of either gas-flow adjusting means that enable the value taken by the angle $\gamma$ defined by the jet of gas issuing from the injector to be adjusted in a continuous manner or, if preferred, gas-flow adjusting means that cause said angle $\gamma$ to vary between pre-defined values comprised between the afore-noted minimum value a and maximum value $\beta$.

The gas burner comprising a plurality of burning portions according to the present invention comprises a controlled gas-jet injector 20 supplying fuel to the various elements of said burner that are adapted to feed the respective burning portions associated thereto. The particular shape and arrangement of some of the elements making up a burner according to the present invention are so selected as to enable them to most effectively receive the jet of gas issued by the injector 20 under all possible conditions of the angle γ thereof.

Figure 2:
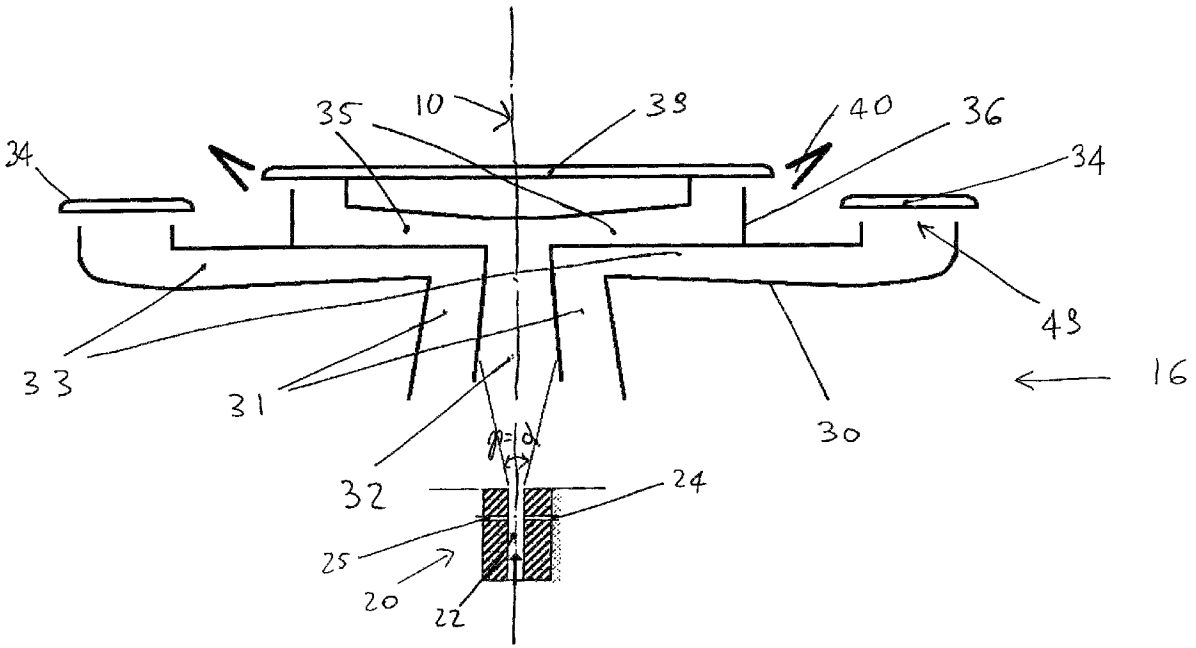
FIGS. 2 and 3 are schematic views of a first preferred embodiment of a gas burner comprising a plurality of burning portions that uses a controlled gas-jet injector according to the present invention, wherein the burning portions consist of a plurality of flame rings.
Figure 3:
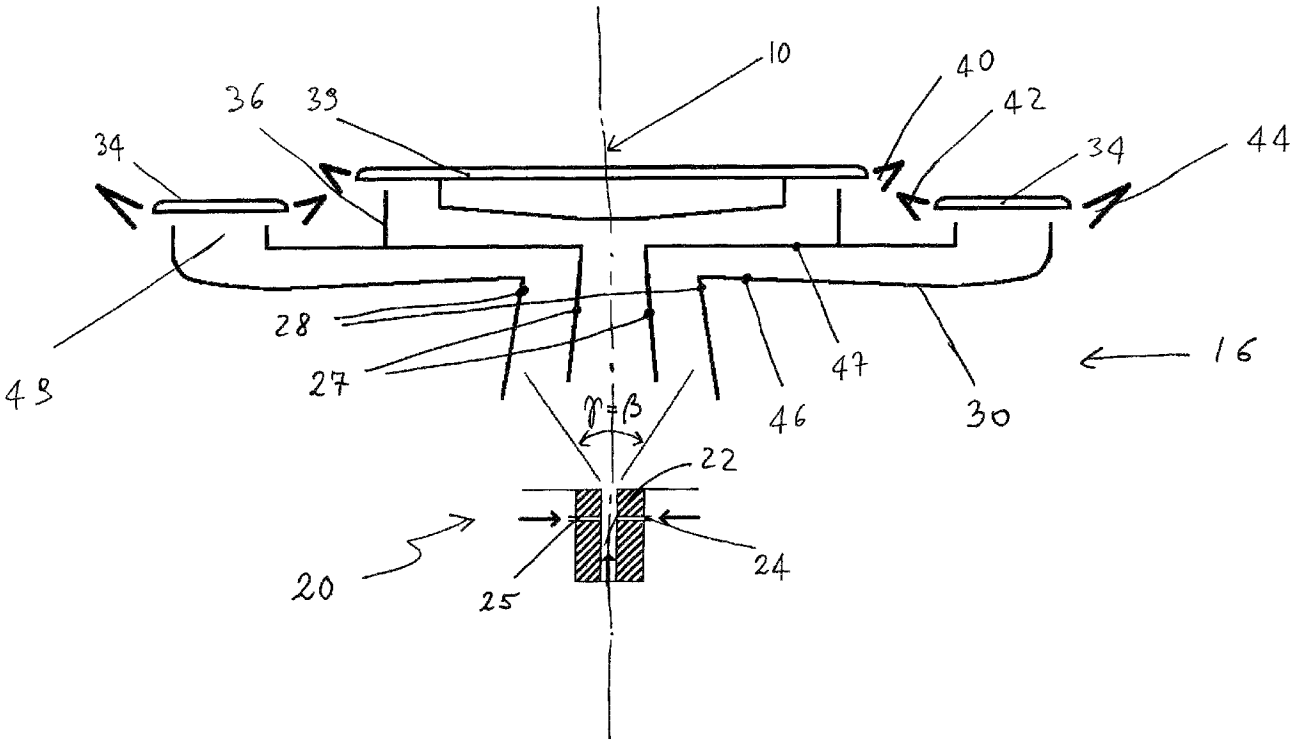

FIGS. 2 and 3 schematically illustrate a first preferred embodiment of a gas burner 16 comprising a plurality of burning portions and making use of a controlled gas-jet injector 20, wherein the burning portions are constituted by a plurality of flame rings, e.g. three such flame rings 40, 42 and 44, as preferably arranged concentrically around the axis of injection 10 of the gas.

The gas burner 16 with several flame rings is comprised of a first peripheral burner element comprising a bowl-shaped body 30 and a ring-shaped burner cap 34, and a second middle burner element comprising a cylindrical body 36 and a ring-shaped burner cap 39. The gas burner 16 further comprises a controlled gas-jet injector 20 supplying the fuel gas to the various burning portions thereof. The injector 20 of the controlled gas-jet type comprises gas injection means 22, 24 and 25. A gas flow adjustment means (not shown) of the type having more operating settings is provided in the usual manner to adjust the heat output of the burner.

The above-cited bowl-shaped body 30 has a shank that is open at the bottom thereof and is delimited at the sides thereof by an inner conical circlet 27 and an outer conical circlet 28 (FIG. 3). These conical circlets 27 and 28 are preferably coaxial relative to each other and the longitudinal axis thereof coincides with the axis of injection 10. Such conical circlets 27 and 28 are tapering upwards, i.e. along the forward-moving direction of the gas flow. At the upper portion thereof, the shank of the bowl-shaped body 30 extends radially outwards, thereby forming a hollow disk with a bore at the centre thereof that is confined by a lower surface 46 and an upper surface 47 of a smaller diameter, so that an annular margin 49 open on top thereof is provided at the extremity of the hollow disk. The circularly shaped burner cap 34 is placed on top of said annular margin 49 of the hollow disk of the bowl-shaped body 30, so as to enable the flame rings 42 and 44 to be formed in this way. Inside the peripheral burner element there are provided two chambers 31 and 32 in communication with each other (FIG. 2), which form a Venturi tube. The gas/air mixture is formed and distributed within such bowl-shaped body 30.

The cylindrical body 36 of the middle burner element rests against the bowl-shaped body 30 of the peripheral burner element, thereby lying coaxially with the latter and creating two chambers 32 and 35 in communication with each other, which form themselves a Venturi tube where the gas/air mixture is formed and distributed.

The converging portion 32 of the Venturi tube of the middle burner element is contained, in a preferably coaxial arrangement, within the converging portion 31 of the Venturi tube of the peripheral burner element. This arrangement of the two devices 31 and 32 for mixing gas and air according to the present invention enables a single injector 20 of the above-cited controlled gas-jet type to be used to supply one or more such flame rings 40, 42 and 44.

The controlled gas-jet injector 20 is located under the shank of the bowl-shaped body 30, where it is arranged to face, i.e. give into the apertures of the two gas/air mixing devices 31 and 32. The flow of the gas delivered into the main conduit 22 and the gas-flow adjusting means 24 and 25 is adjusted through an adjustment means that may for instance be a gas cock or a valve (not shown), in which there are provided several operating settings. In a first operating setting of such gas-flow adjustment means, in which gas is being solely injected through the main conduit 22, the gas jet at the outlet of the controlled gas-jet injector 20 is issued at an angle $\gamma=\alpha$, so that it is solely directed to hit and enter the inner mixing device 32 and, as a result, the sole flame ring 40 is supplied, as illustrated in FIG. 2. In a second operating setting of the gas-flow adjustment means, in which gas is being injected both through the main conduit 22 and through the gas-flow adjusting means 24 and 25, the gas jet at the outlet of the controlled gas-jet injector 20 is issued at an angle $\gamma=\beta$, so that it is directed to hit and enter both mixing devices 31 and 32 and, as a result, all flame rings 40, 42 and 44 are supplied, as this is best shown in FIG. 3. In this case, owing to an increase in the level of turbulence brought about by the gas jet expanding with a motion that is comprised of a central component directed along the axis of injection 10 and a peripheral tangential component around the axis of injection 10, a greater amount of air is drawn into the two air/gas mixing devices 31 and 32, and this fact contributes to an increased efficiency of the gas burner 16.

Figure 4:
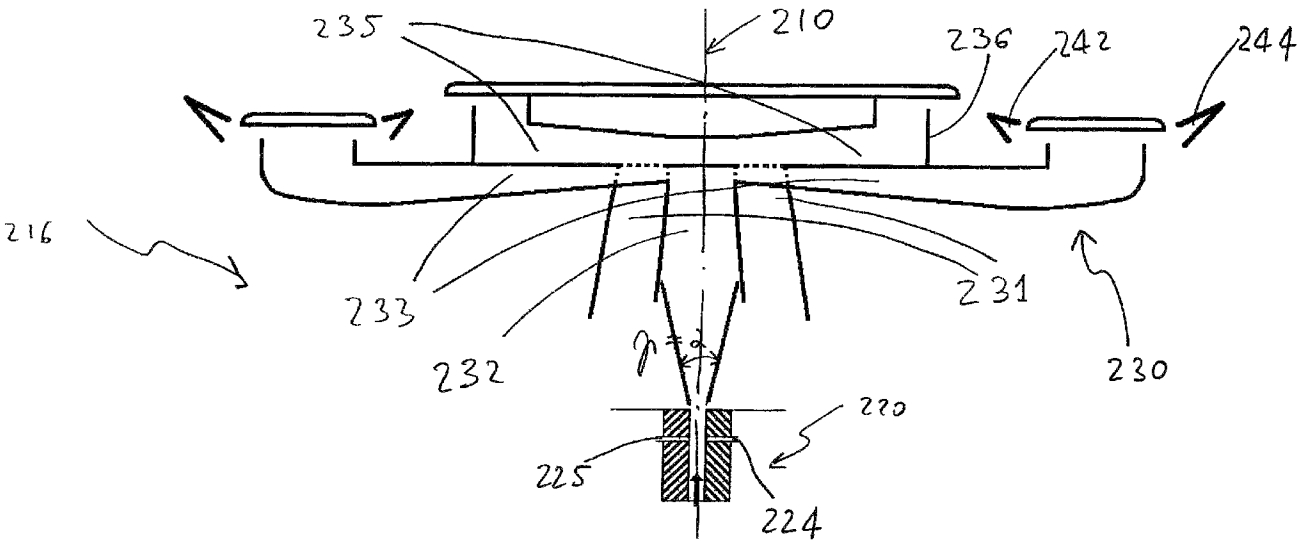
FIGS. 4 and 5 are schematic views of a variant of the above-cited first preferred embodiment, in which there is provided a further gas burner featuring a plurality of flame rings.
Figure 5:
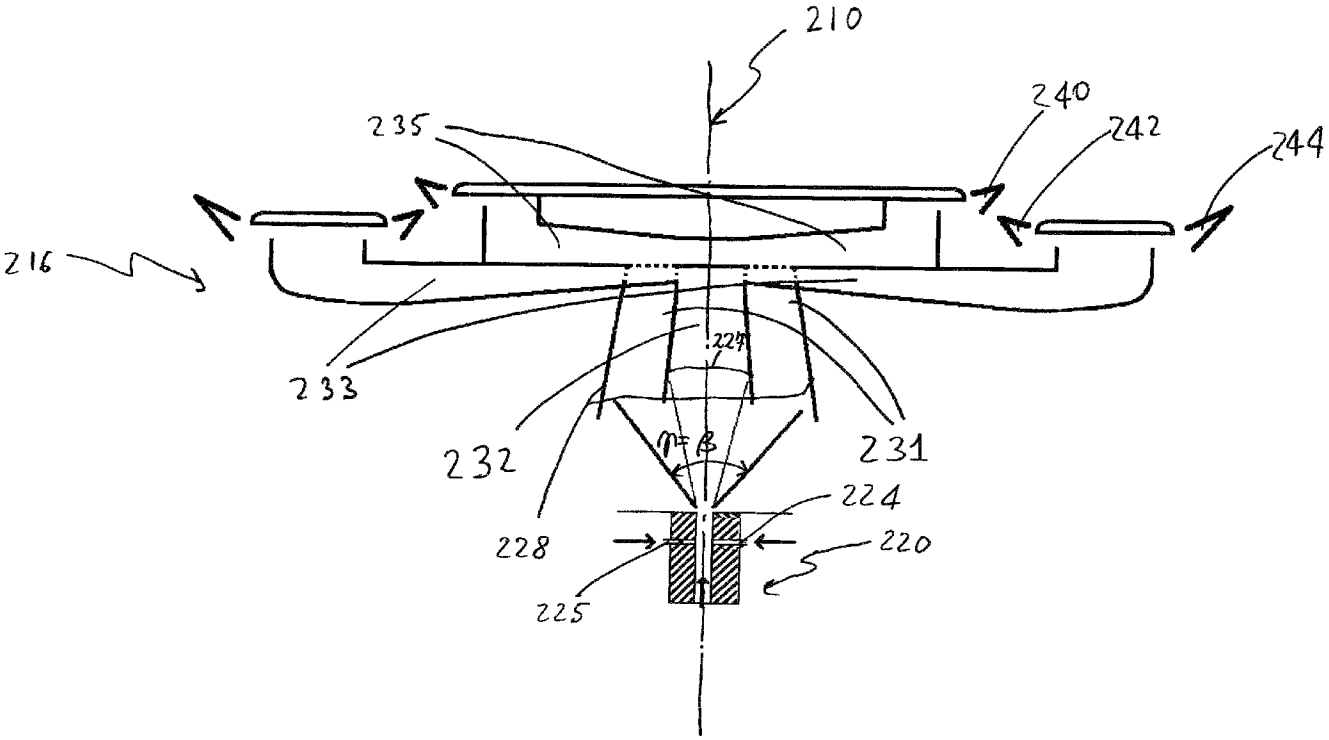

Schematically illustrated in FIGS. 4 and 5 is a variant of the first preferred embodiment described above, in which a further gas burner 216 featuring several flame rings has a construction that is similar in all parts thereof to the one of the burner considered in connection with the afore-described first preferred embodiment, and in which the only difference existing as compared with the latter lies in the manner in which gas is in this case fed to the flame rings 240, 242 and 244, which are preferably arranged concentrically around the gas injection axis 210. Namely, the bowl-shaped body 230 comprises an inner air/gas mixing device 233 for feeding the flame rings 242 and 244, whereas the cylindrical body 236 comprises the outer air/gas mixing and distributing device 231 that is connected with the air/gas distributing device 235 for feeding the flame ring 240. Similarly to what has been described afore with reference to FIGS. 2 and 3, these inner and outer air/gas mixing devices 232 and 231 are defined by conical circlets 227 and 228 that are preferably arranged coaxially around the gas injection axis 210.

As a result, in a first operating setting of the gas-flow adjustment means, in which the gas jet at the outlet of the injector 220 is issued at an angle $\gamma=\alpha$, the same gas jet is directed to hit and enter the inner mixing device 232 so as to supply the flame rings 242, 244, as illustrated in FIG. 4; conversely, in a second operating setting of the gas-flow adjustment means, in which the gas jet at the outlet of the controlled gas-jet injector 220 is issued at an angle $\gamma=\beta>\alpha$, the same gas jet is directed to hit and enter both mixing devices 231 and 232 and, as a result, all flame rings 240, 242 and 244 are supplied, as this is best shown in FIG. 5.

FIGS. 6 and 7 schematically illustrate a second preferred embodiment of the present invention, in which there is provided a gas burner 316 having a single flame ring with an adjustable heat output, wherein the afore-mentioned burning portions are constituted of a plurality 350 of main flame ports and a plurality 352 of auxiliary flame ports, respectively. The single flame ring is made up by the composition of the above-cited flame ports 350 and 352.

A gas burner 316 with a single adjustable-output flame ring is comprised of a base portion comprising a bowl-shaped body 330, and a top member comprising a cylindrical body 336 and a ring-shaped burner cap 339. The bowl-shaped body 330 has a shank that is open at the bottom thereof and is delimited at the sides thereof by an inner conical circlet 327 and an outer conical circlet 328. These conical circlets 327 and 328 are preferably coaxial relative to each and are tapering upwards, i.e. along the forward-moving direction of the gas flow. At the upper portion thereof, the shank of the bowl-shaped body 330 extends radially outwards, thereby forming a hollow disk with a bore at the centre thereof that is confined by a lower surface 346 and an upper surface 347 having the same diameter. The peripheral circumferential borders 357 and 359 of the surfaces 346 and 347 enter into contact against the respective ones of the opposite edges of a same side surface 354 of the base portion, in which there is formed said plurality 352 of apertures. Provided in this way is practically an air/gas mixing a distributing device 331, 333 that feeds the plurality 352 of auxiliary flame ports.

The base portion assembles coaxially along the axis 310 with the top member, the latter being obtained by placing the burner cap 339 upon the cylindrical body 336 so as to form the plurality 350 of main flame ports. Such plurality 350 of main flame ports may of course be formed directly in the side surface of the cylindrical body 336. This cylindrical body 336 fits into or couples with the side surface 354 of the base portion without any interruption of cylindrical continuity; as a result the two pluralities 350 and 352 of flame ports come to lie on a same cylindrical surface, thereby composing the same flame ring that, for this reason, turns out as being capable of delivering an adjustable heat output, thanks to said pluralities 350 and 352 of flame ports being capable of being fed independently of each other.

This overall composition of the various elements and members making up the gas burner 316 is such as to further create two chambers 332 and 335 in communication with each other, which form a Venturi tube, in which gas and air are mixed and the resulting air/gas mixture is distributed to feed the plurality 350 of main flame ports. The converging portion 332 of the Venturi tube of the top burner portion is contained within the converging portion 331 of the Venturi tube of the base burner portion. This arrangement of the two devices 331 and 332 for mixing gas and air according to the present invention enables a single injector 320 of the afore-cited controlled gas-jet type to be used to supply both pluralities of flame ports 350, 352.

The controlled gas-jet injector 320 is located under the shank of the bowl-shaped body 330, where it is arranged to face, i.e. give into the apertures of the two gas/air mixing devices 331 and 332.

The operating principle is similar to the one of the afore-described embodiments, so that any further explanation is intentionally omitted in this case. However, for reasons of greater clarity, it seems appropriate for a sole characteristic part of the operation to be reminded here, namely the part in which the heating portion of the burner formed of the plurality 350 of flame ports is fed with fuel gas through the controlled gas-jet injector 320 when the injection angle $\gamma$ of the gas is equal to a (FIG. 6), whereas both burning or heating portions of the burner formed of the pluralities 350 and 352 of flame ports are fed with fuel gas when the injection angle $\gamma$ of the gas is equal to $\beta>\alpha$ (FIG. 7).

It is of course possible for the gas supply means to be arranged so as to be able to just feed a definite set of said pluralities 350 and 352 of flame ports in accordance with, i.e. depending on the value taken by the angle $\gamma$, so that the individual burning portions are capable of being activated sector-wise, i.e. solely individual sectors or segments of said burning portions are capable of being selectively ignited.

Both such first and second preferred embodiments described above can of course be appreciated to also contemplate the case in which the respective burners might be provided with a first air/gas mixing device 31; 231; 331 containing a second air/gas mixing device 32; 232; 332 in a non-coaxial arrangement. In addition, such air/gas mixing devices 31; 231; 331 and 32; 232; 332—one contained within the other one—might be provided in a larger number than two, e.g. three of them, thereby making it possible for three respective distinct burning portion to be individually fed with fuel mixture in this case.

FIGS. 8 and 9 schematically illustrate a third preferred embodiment of a gas burner of a catalytic type comprising a plurality of burning portions, wherein such burning portions are identifiable as portions of a support of porous material 464.

A catalytic gas burner 416 comprises said support of porous material 464, a chamber 466, as well as the afore-cited controlled gas-jet injector 420. The support of porous material 464 consists of a polyhedral structure having a plurality of channels or capillaries 468 extending substantially along the axis 410. These channels or capillaries 468 may be either separated from each other, i.e. non-communicating with each other, as this is represented in FIGS. 8 and 9, or may be organized into sectors comprising communicating channels, wherein the various sectors are however isolated from each other. In the support of porous material 464 there is further dispersed a catalyst means that enables the combustion process to take place, i.e. brings about such combustion process. The chamber 466 is a stationary fixture that sustains—with the aid of means generally known as such in the art (not shown in the Figures)—the support of porous material 464. To this purpose, such chamber is in fact provided with a first open end portion in an appropriate polyhedral shape ensuring a sealed, gas-tight coupling with the support of porous material 464. In a second end portion of the chamber 466 lying opposite to the above-cited first one, there is provided a bore enabling the controlled gas-jet injector 420—which is associated to said chamber 466 with the use of means largely known as such in the art—to be inserted thereinto.

The controlled gas-jet injector 420 is oriented so as to give onto, i.e. face a side of said support of porous material 464, which is in this way exposed to a flow of gas being injected thereagainst, which—by mixing up with air there—enables combustion to take place. Through a proper actuation means (not shown), such as a gas cock or a valve, in which there are provided several operating settings, the gas flow rate can be regulated and the gas-flow adjusting means 424, 425 can be controlled to correspondingly control the issuing angle $\gamma$ of the gas. In a first such operating setting of said actuator means, the jet of gas is issued at an angle $\gamma=\alpha$, so that it is solely directed to hit a first portion 460 of the support of porous material 464 consisting of a first set of channels 468, i.e. burning portions. This portion 460 is therefore supplied with fuel mixture and combustion can take place accordingly. In a second operating setting of said actuator means, the gas-flow adjusting means 424, 425 modify the above-cited angle $\gamma$ changing its value to $\gamma=\beta$. The gas jet is thereby directed to hit a second portion or set 464 of burning portions—in addition to the afore-cited first portion 460—so that combustion is allowed to substantially take place over the entire surface of the support of porous material 464. The gas-flow adjusting means 424, 425 are capable of allowing the variation of the angle $\gamma$ to be performed both continuously or at discrete steps between the minimum value a and the maximum value $\beta$, so that the actual area of porous support 464 involved by combustion will have a variable extension depending on the value taken by said angle $\gamma$.

As a result, the arrangement according to the present invention is fully effective in reaching the afore-indicated aims. In particular, it ensures that a set of burning portions are capable of being supplied in a controllable manner from a single injector 20 of the controlled gas-jet type in an efficient manner according to the actual needs. With the arrangement according to the present invention, the possibility is given for cooktops to be provided, in which the individual burner is capable of having its heating area adapted in accordance with the size of the container, i.e. pan or pot to be heated. An advantageous fuel saving effect can in this way be obtained, while ensuring improved cooking performance and results at the same time.

It will be readily appreciated that the present invention may be embodied in a number of manners differing from the above-described one, and may be the subject of a number of further modifications, without departing from the scope of the present invention.

The invention claimed is:

1. Gas burner comprising a plurality of burning portions adapted to receive a gas flow from gas supply means that comprise an injector means adapted to eject a gas flow diverging along the flow direction to define a spreading angle $\gamma$, characterized in that gas-flow adjusting means are provided for modifying said spreading angle $\gamma$ such that said gas flow is enabled to supply one or more of said plurality of burning portions through at least one of a first chamber and a second chamber coaxial with the first chamber depending on the adjustment of said spreading angle $\gamma$; wherein at a first adjustment of said spreading angle $\gamma$, said gas flow is enabled to supply through the first chamber and not through the second chamber; wherein at a second adjustment of said spreading angle $\gamma$, said gas flow is enabled to supply through the second chamber; wherein said plurality of burning portions are supplied by a single injector means; and wherein said gas-flow adjusting means are formed on said injector means.

2. Gas burner according to claim 1, wherein said plurality of burning portions are fed by a plurality of Venturi tubes having portions facing said injector means and arranged coaxially around a gas-flow injection axis.

3. Gas burner according to claim 1, wherein said plurality of burning portions are in the form of a plurality of flame rings.

4. Gas burner according to claim 3, wherein said plurality of flame rings are provided in a concentric arrangement around a gas-flow injection axis.

5. Gas burner according to claim 1, wherein said plurality of burning portions are in the form of a first and a second plurality of flame ports arranged so as to form a single flame ring extending around a gas-flow injection axis.

6. Gas burner according to claim 1, wherein catalytic means adapted to bring about a gas combustion process are dispersed in a support of porous material of the burning portion.

7. Gas burner according to claim 1, wherein said spreading angle $\gamma$ varies between a first minimum value $\alpha$ when said gas-flow adjusting means are inactive, and a second maximum value $\beta$>a under the effect produced by said gas-flow adjusting means being operative.

8. Gas burner according to claim 7, wherein said gas-flow adjusting means are adapted to modify said spreading angle $\gamma$ between said first minimum value $\alpha$ and said second maximum value $\beta$ thereof either continuously or selectively in discrete steps.

9. Gas burner according to claim 8, wherein said plurality of burning portions are arranged such that at least one of said burning portions is activated when $\gamma=\alpha$, while all such burning portions are activated when $\gamma=\beta$.

10. Gas burner according to claim 9, wherein said gas-flow adjusting means comprise a pair of conduits extending perpendicularly to the longitudinal axis of a main conduit, said pair of conduits being connected to said main conduit tangentially.

11. Gas Burner according to claim 10, wherein said gas-flow adjusting means are adapted to inject a gas flow into the main conduit to thereby modify the spreading angle $\gamma$ between a minimum value a and a maximum value $\beta>\alpha$ thereof.

12. Cooktop comprising at least one gas burner according to claim 1.

13. Cooktop according to claim 12, wherein said gas-flow adjusting means are activated through a knob-operated gas cock or valve means.

14. Gas Burner according to claim 1, wherein said gas flow adjusting means are provided as air passages located in the injector means to adjust gas flow injected through a main conduit of the injector means.

15. Gas burner according to claim 6, wherein said porous material is arranged such that when the jet of gas is issued at a spreading angle $\gamma'=\alpha$, the gas is solely directed to hit a first portion of the support of porous material, and when the jet of gas is issued at spreading angle $\gamma=\beta$, the gas is directed to hit a second portion including the first portion so that combustion substantially takes place over the entire surface of the support of porous material.

16. Gas Burner according to claim 1, further comprising a valve for adjusting the spreading angle $\gamma$ by controlling the flow of gas to the gas-flow adjusting means.

17. Gas Burner according to claim 1, wherein said gas flow supplies enough gas to ignite one or more than one of said plurality of burning portions depending on the adjustment of said spreading angle $\gamma$.

18. Gas burner, comprising:

a gas supply means comprising an injector means adapted to eject a gas flow diverging along the flow direction to define a spreading angle $\gamma$;

a first chamber and a second chamber coaxial with the first chamber;

a plurality of burning portions adapted to receive the gas flow from the gas supply means through the first chamber and the second chamber; and a gas-flow adjusting means provided for modifying the spreading angle $\gamma$ such that the gas flow is selectively directed to the first chamber and the second chamber and is enabled to supply one or more of the plurality of burning portions depending on the adjustment of the spreading angle $\gamma$, wherein at a first adjustment of the spreading angle $\gamma$, the gas flow is enabled to supply one or more of the plurality of burning portions through the first chamber and not through the second chamber;

wherein at a second adjustment of the spreading angle $\gamma$, the gas flow is enabled to supply one or more of the plurality of burning portions through the second chamber, wherein at least some of the burning portions supplied through the second chamber are different than that burning portions supplied through the first chamber;

wherein said plurality of burning portions are supplied by a single injector means; and wherein said gas-flow adjusting means are formed on said injector means.

19. Gas burner, comprising:

a plurality of burning portions adapted to receive a gas flow from gas supply means that comprise an injector means adapted to eject a gas flow diverging along the flow direction to define a spreading angle $\gamma$, characterized in that gas-flow adjusting means are provided for modifying said spreading angle $\gamma$ such that said gas flow is enabled to supply one or more of said plurality of burning portions through at least one of a first chamber and a second chamber coaxial with the first chamber depending on the adjustment of said spreading angle γ;

wherein said burning portions are formed of a plurality of vertical capillaries adapted to receive a gas flow from gas supply means;

wherein at a first adjustment of said spreading angle γ, said gas flow is enabled to supply through the first chamber and not through the second chamber; wherein at a second adjustment of said spreading angle γ, said gas flow is enabled to supply through the second chamber;

wherein said plurality of burning portions are supplied by a single injector means; and wherein said gas-flow adjusting means are formed on said injector means.

20. Gas burner according to claim 19, wherein said plurality of vertical capillaries are separated from each other.

21. Gas burner according to claim 19, wherein said plurality of vertical capillaries are arranged to form individual sectors that are separated from each other, and wherein said plurality of vertical capillaries within each such sector are communicating with each other.

* * * * *